United States Patent [19]
Voswinckel et al.
[11] 4,449,476
[45] May 22, 1984

[54] APPARATUS FOR COATING OR IMPREGNATING A GUIDED SUBSTRATE IN THE FORM OF A WEB

[75] Inventors: Gerhard Voswinckel, Aachen; Joachim Trauter, Denkendorf, both of Fed. Rep. of Germany

[73] Assignee: Gebrueder Sucker, Monchen-Gladbach, Fed. Rep. of Germany

[21] Appl. No.: 462,064

[22] Filed: Jan. 28, 1983

[30] Foreign Application Priority Data

Jan. 30, 1982 [DE] Fed. Rep. of Germany ..... 3203087

[51] Int. Cl.[3] ..... B05B 7/06

[52] U.S. Cl. ..... 118/674; 118/405; 118/414; 118/419; 118/694; 118/697

[58] Field of Search ..... 118/674, 405, 414, 419, 118/694, 696, 697

*Primary Examiner*—Bernard D. Pianalto

*Attorney, Agent, or Firm*—Herbert L. Lerner; Laurence A. Greenberg

[57] ABSTRACT

Method of coating or impregnating a guided web-shaped substrate with a flowable medium, which includes monitoring the composition of the flowable medium; continuously measuring the rate of travel of the substrate; applying a metered amount of flowable medium to the substrate at a given feeding point, corresponding to the monitored composition of the flowable medium and corresponding to the measured rate of travel of the substrate; continuously measuring the amount of flowable medium not yet accepted by the substrate; and regulating the transfer of flowable medium to the moving substrate corresponding to the measured amount of flowable medium to maintain a constant amount of flowable medium applied within pre-determined limits, and an apparatus for carrying out the method.

12 Claims, 2 Drawing Figures

FIG. 1
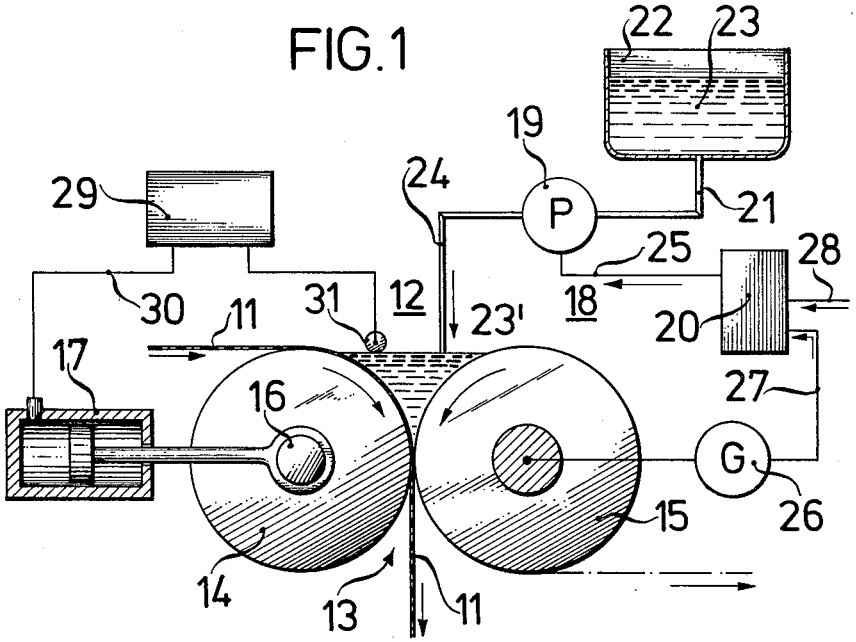
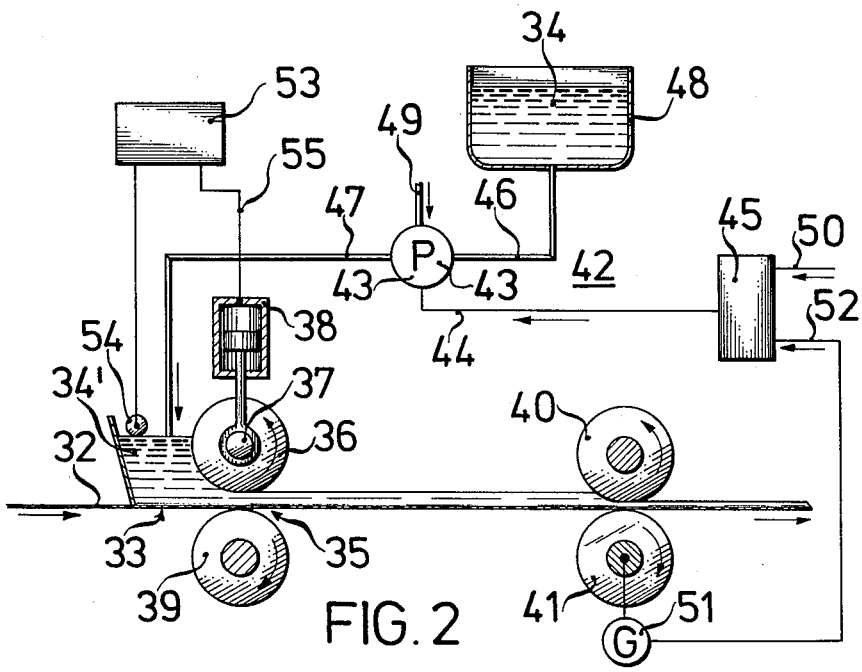
FIG. 2

APPARATUS FOR COATING OR IMPREGNATING A GUIDED SUBSTRATE IN THE FORM OF A WEB

SPECIFICATION

The invention relates to a method and an apparatus for coating or impregnating a guided substrate in the form of a web, with a flowable medium. For example, a fabric web may be used as the substrate and finishing agents, coloring solutions, washes, high viscosity solutions, dispersions, foams or the like, may be applied as the flowable medium.

It is known in the art to coat or to impregnate a substrate in such a manner that the substrate is brought in contact with the flowable medium over a certain contact length. The penetration of the flowable medium into the substrate is thereby effected by a predetermined dwell period (reaction time). The amount of flowable medium per unit length of substrate is thereafter controlled by squeezing rollers. It is also known to set the amount of flowable medium by an exact metering of viscosity, without the use of squeezing rollers.

It has also been proposed to introduce the flowable medium immediately before or directly into the gap (roller-gap) of a pair of squeezing rollers, and to meter it in this manner.

However, the known methods and devices do not achieve a sufficiently uniform coating or impregnation.

Especially with highly concentrated solutions and foams, experience has shown that the material interaction or exchange cannot be sufficiently improved by processes relying on the dwell period. Depending on the kind of substrate, it has also already been attempted to achieve a satisfactory wetting of the substrate by repeated soaking and squeezing. Besides the fact that this is very uneconomical, it is also not possible to achieve good results with this method in all cases.

In the case of certain substrates, a repeated soaking and squeezing is destined to be difficult and is not successful, due to the difficult handling of the material in the wet state, leading to folds in the web or to knurling of individual threads.

With the conventional methods based on soaking and squeezing, experience has shown that a sufficient impregnation by changing the velocity of the web, especially by a repeated change to slow motion several times cannot be achieved, in spite of the fact that the dwell time of the substrate in the impregnation medium is many times greater than the normal production speed.

Furthermore, in the conventional methods, quite narrow limits are set for the concentration of the solution, dispersions and foams used.

It is accordingly an object of the invention to provide a method and apparatus for coating or impregnating a guided substrate in the form of a web, which overcomes the hereinafore-mentioned disadvantages of the heretofore-known methods and devices of this general type, and to produce a very uniform coating or impregnation even when using highly viscous impregnation media containing little solvent, or when using foams.

With the foregoing and other objects in view there is provided, in accordance with the invention, a method of coating or impregnating a guided web-shaped substrate with a flowable medium, which comprises monitoring the composition of the flowable medium; continuously measuring the rate of travel of the substrate or web; applying a metered amount of flowable medium to the substrate at a given feeding point, corresponding to the continuously monitored or controlled composition of the flowable medium and corresponding to the measured rate of travel of the substrate; continuously measuring the amount of flowable medium not yet accepted by the substrate or the level of flowable medium already delivered; and regulating the transfer of flowable medium to the moving substrate corresponding to the measured amount or level of flowable medium to maintain a constant amount of flowable medium applied or level of flowable medium, within predetermined limits.

In accordance with another mode of the invention, there is provided a method which comprises monitoring the composition of the flowable medium continuously.

In accordance with a further mode of the invention, there is provided a method which comprises controlling the composition of the flowable medium while monitoring.

In accordance with an added mode of the invention, there is provided a method which comprises continuously measuring the amount of flowable medium not yet accepted by the substrate, at the feeding point or downstream of the feeding point.

In accordance with an additional mode of the invention, there is provided a method which comprises continuously measuring the level of flowable medium already delivered, at the feeding point or downstream of the feeding point.

In accordance with again another feature of the invention, there is provided an apparatus for coating or impregnating a guided web-shaped substrate with a flowable medium, comprising a feeding location through which the substrate is moved and is soaked into or coated onto the flowable medium, fluid transfer means disposed in vicinity of the feeding location for controllably transferring the flowable medium to the substrate, a metering device for the flowable medium having an outlet or delivery side in communication with the feeding location and an inlet, a storage tank for the flowable medium being connected to the inlet, means operatively connected to the metering device for measuring the rate of travel of the substrate, and means operatively connected to the transferring means for regulating and constantly maintaining the amount of flowable medium at the feeding location.

In accordance with again a further feature of the invention, the transferring means is disposed at the feeding location or downstream of the feeding location, as seen in travel direction of the substrate.

In accordance with again an added feature of the invention, the regulating means holds constant or constantly regulates the amount of the flowable medium already present at the feeding location but not yet accepted by the substrate.

In accordance with again an additional feature of the invention, the regulating means holds the level of the flowable medium at the feeding location constant.

In accordance with yet another feature of the invention, the transferring means includes a pair of squeezing rollers having a gap formed therebetween at an inlet location thereof defining the feeding location, one of the rollers having an adjustable roller journal, and including a setting motor connected to the adjustable roller journal.

In accordance with yet a further feature of the invention, the transferring means includes an adjustable wiper roller having a gap at an input location thereof defining the feeding location.

In accordance with yet an added feature of the invention, the metering device includes a metering pump, and including a computer being connected to the metering pump for transmitting control pulses to the metering pump, the computer receiving input data regarding the output or input quantity of the flowable medium and the rate of travel of the substrate for computing the control pulses.

In accordance with yet an additional feature of the invention, the input data are chosen from the group consisting of the weight of the substrate, the composition of the flowable medium and the consistency of the flowable medium.

In accordance with still a further feature of the invention, the measuring means is in the form of a tachometer-generator, and the transferring means includes a roller connected to the tachometer-generator, being in contact with and rotating at a rate proportional to, the rate of travel of the substrate.

In accordance with a concomitant feature of the invention, the transferring means includes at least one roller having an inlet location defining the feeding location, the roller having an adjustable roller journal and a setting motor connected to the adjustable roller journal, the regulating means including a sensor for measuring the level of the flowable medium at the feeding location, and the regulating means being operatively connected to the setting motor.

The advantages obtained by the invention are especially that the amount of flowable medium per unit length of substrate is held constant. This results in a very uniform impregnation or coating, respectively. However, the invention also makes it possible to use impregnation media containing little solvent or with high viscosity, so that the cost for a subsequently required drying of the substrate is reduced. The invention also allows the advantageous use of a flowable medium in the form of a foam for such substrates where the use of a foam seems suitable.

One great advantage of the invention lies in the fact that with varying production speeds, and in particular in the case of the repeatedly required change to crawling speeds and back to normal speed, no disturbances, uneven conditions or faulty impregnations occur.

Other features which are considered as characteristic for the invention are set forth in the appended claims.

Although the invention is illustrated and described herein as embodied in a method and apparatus for coating or impregnating a guided substrate in the form of a web, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIGS. 1 and 2 are similar diagrammatic and schematic views of two different embodiments of the invention.

Referring now to the figures of the drawing in detail, and first particularly to the first embodiment according to FIG. 1 thereof, it is seen that a substrate 11 in the form of a web moves to a feeding point 12, at which a liquid or flowable medium which is to penetrate the substrate 11, is applied to the substrate. As seen in direction of web travel, a controllable fluid transfer device 13 is disposed directly downstream of the feeding point 12. This fluid transfer device 13 is formed of a pair of squeezing or crushing rollers 14, 15. The roller journal of the squeezing or crushing roller 14 is adjustably supported, in connection with a setting motor 17. The feeding point in this case is the gap on the input side of the squeezing roller pair 14, 15.

A metering device for the liquid medium, which is designated as a whole with reference numeral 18, includes a controllable metering pump 19 which is connected to a computer 20. The metering pump 19 is connected by a pipeline 21 with a storage tank 22, in which a certain amount of flowable medium 23 is contained. At the output side thereof, the metering pump 19 is connected to the feeding point 12 through a pipeline 24. An operative connection 25 connects the metering pump 19 with the computer 20.

The computer functions to calculate control pulses, and to transmit them to the metering pump 19. The determination of the control pulses is effected, for example, by fixed programs from determined input data, such as the specific substrate weight, the composition and sometimes also the consistency of the flowable medium, the specific feed-in or input quantity of the flowable medium, and the continuously measured throughput velocity (throughput rate). A measuring device 26 for measuring the throughput velocity or rate of travel of the substrate, is formed of a tachometer-generator, which is attached to the squeezing roller 15, and is connected to the computer 20 by a line 27. An arrow 28 indicates a data input point for the computer 20.

A regulating device 29 seen in the drawing, has an operative connection 30 with the setting motor 17 of the fluid transfer device 13. Furthermore, the regulating device 29 also includes a measuring sensor 31 which monitors the height of the liquid level of the medium 23' at the feeding point 12.

In the case of this embodiment which is given as an example, the composition of the flowable medium 23 and its viscosity or the degree to which it has been diluted (thinned), respectively, must be determined in advance. The respective data must be fed into the computer 20. At the beginning of the impregnating process, enough of the liquid medium 23' is introduced into the feeding point 12 to trigger the measuring sensor 31. Thereafter, the pair of squeezing rollers 14, 15 is set in operation, causing additional medium drawn from the storage tank 22 to be fed to the feeding point 12 by the metering pump 19 in amounts corresponding to the number of revolutions measured by the tachometer-generator 26, which controls the metering pump with the aid of the computer 20. The tachometer-generator or regulator 29 keeps the height of the liquid level at the feeding point 12 constant, by adjusting the spacing between the two squeezing rollers 14, 15.

In the case of the second typical embodiment according to FIG. 2, a substrate 32 in the form of a web passes horizontally through a feeding point 33, where a flowable medium 34' which is to penetrate the substrate is applied to the substrate.

Immediately after the feeding point 33, a controllable fluid-transfer device 35 is provided. The fluid transfer device 35 includes an adjustable wiper roller 36, having a roller journal 37 which is connected to a setting motor 38. Under the wiper roller 36, the substrate 32 is supported by a rotating roller 39. At the feeding point 33, the wiper gap or clearance at the input side of the wiper roller 36 is limited by a wall.

Downstream of the wiper roller 36, a pair of squeezing or crushing rollers 40, 41 is disposed. This pair of squeezing rollers functions to further help the penetration of the liquid medium into the substrate. For example, the flowable medium could be a foam, in this case.

A metering device for the flowable medium, which as a whole is designated with reference numeral 42, includes a metering pump 43 which is connected through an operative connection 44 to a computer 45. A pipeline 46 connects the metering pump 43 with a storage tank 48, which contains the flowable medium 34 that has not yet foamed-up. The foaming is effected by adding air through an aeration device 49 in the metering pump 43. A pipeline 47 connects the metering pump 43 with the feeding region 33.

The computer 45 determines control pulses, which it transmits through the operative connection 44 to the metering pump 43. The control pulses are calculated from the input data already mentioned as an example with regard to the first embodiment. A data input point is indicated by an arrow 50. A measuring device 51 for the average speed of the substrate 32 is attached to the squeezing roller 41. The measuring device 51 is in the form of a tachometer-generator (tachogenerator). The tachometer-generator 51 has an operative connection 52 with the computer 45.

A regulating device 53 is provided for holding constant or for constantly regulating the amount of flowable medium 34', which is foam in this case, that is already present in the feeding point, but has not yet been accepted by the substrate 32. The regulating device 53 in this case also has a measuring sensor 54 which measures the level of the flowable medium 34'. The regulating device 53 furthermore has an operative connection 55 with the setting motor 38.

At the beginning of the impregnation process, foamed flowable medium 34' is introduced into the feeding point or region 33, so that the measuring sensor 54 reacts. Then, the squeezing rollers 40, 41, the support roller 39 and the wiper roller 36 are set in rotation, and the substrate 32 simultaneously begins to move in the direction of the arrow shown. Further addition of flowable medium 34' takes place only according to the measured throughput velocity or rate of travel of the substrate 32. The height of the level at the feeding region 33 is kept constant by changing the distance between the support roller 39 and the wiper roller 36.

The invention is not limited to the illustrated and described typical embodiments. Metering pumps, computers and regulating devices as individual components are known in the art. Therefore, their internal functioning will not be explained at this point. The same applies for setting motors, tachometer-generators and measuring sensors.

The foregoing is a description corresponding to German application No. P32 03 087.8, dated Jan. 30, 1982, the International priority of which is being claimed for the instant application, and which is hereby made part of this application. Any discrepancies between the foregoing specification and the aforementioned corresponding German application are to be resolved in favor of the latter.

We claim:

1. Apparatus for coating or impregnating a guided web-shaped substrate with a flowable medium, comprising a feeding location through which the substrate is moved and is impinged by the flowable medium, means disposed in vicinity of said feeding location for controllably transferring the flowable medium to the substrate, a metering device for the flowable medium having an outlet in communication with said feeding location and an inlet, a storage tank for the flowable medium being connected to said inlet, means operatively connected to said metering device for measuring the rate of travel of the substrate, and means operatively connected to said transferring means for regulating and constantly maintaining the amount of flowable medium at said feeding location.

2. Apparatus according to claim 1, wherein said transferring means is disposed at said feeding location.

3. Apparatus according to claim 1, wherein said transferring means is disposed downstream of said feeding location, as seen in travel direction of the substrate.

4. Apparatus according to claim 1, wherein said regulating means holds constant the amount of the flowable medium already present at said feeding location but not yet accepted by the substrate.

5. Apparatus according to claim 1, wherein said regulating means constantly regulates the amount of the flowable medium already present at said feeding location but not yet accepted by the substrate.

6. Apparatus according to claim 1, wherein said regulating means holds the level of the flowable medium at said feeding location constant.

7. Apparatus according to claim 1, wherein said transferring means includes a pair of squeezing rollers having a gap formed therebetween at an inlet location thereof defining said feeding location, one of said rollers having an adjustable roller journal, and including a setting motor connected to said adjustable roller journal.

8. Apparatus according to claim 1, wherein said transferring means includes an adjustable wiper having a gap at an input location thereof defining said feeding location.

9. Apparatus according to claim 1, wherein said metering device includes a metering pump, and including a computer being connected to said metering pump for transmitting control pulses to said metering pump, said computer receiving input data regarding the output or input quantity of the flowable medium and the rate of travel of the substrate for computing said control pulses.

10. Apparatus according to claim 9, wherein said input data are chosen from the group consisting of the weight of the substrate, the composition of the flowable medium and the consistency of the flowable medium.

11. Apparatus according to claim 1, wherein said measuring means is in the form of a tachometer-generator, and said transferring means includes a roller connected to said tachometer-generator, said roller being in contact with and rotating at a rate proportional to the rate of travel of said substrate.

12. Apparatus according to claim 1, wherein said transferring means includes at least one roller having an inlet location defining said feeding location, said roller having an adjustable roller journal and a setting motor connected to said adjustable roller journal, said regulating means including a sensor for measuring the level of the flowable medium at said feeding location, and said regulating means being operatively connected to said setting motor.

* * * * *